US005458100A

United States Patent [19]

Neuenfeld

[11] Patent Number: 5,458,100

[45] Date of Patent: Oct. 17, 1995

[54] PILOT RING ATTACHMENT ASSEMBLY

[75] Inventor: Edward W. Neuenfeld, Kohler, Wis.

[73] Assignee: Kohler Co., Kohler, Wis.

[21] Appl. No.: 336,950

[22] Filed: Nov. 10, 1994

[51] Int. Cl.[6] ..... F02F 7/00

[52] U.S. Cl. ..... 123/195 A; 74/11; 74/15.63; 29/402.06

[58] Field of Search ..... 123/195 R, 195 A; 74/11, 15.63; 29/402.06, 402.15

*Primary Examiner*—Noah P. Kamen

*Attorney, Agent, or Firm*—Quarles & Brady

[57] ABSTRACT

A pilot ring assembly is provided for locating various power driven apparatus with respect to a power source housing such as an engine or motor. The ring assembly obviates having to machine locator steps of various diameters in flanges on the engine block or motor housing. This is effected by machining locator steps in flanges at a predetermined position and then placing pilot rings of varying outside diameters to accommodate the locator rings of the power driven apparatus.

10 Claims, 2 Drawing Sheets

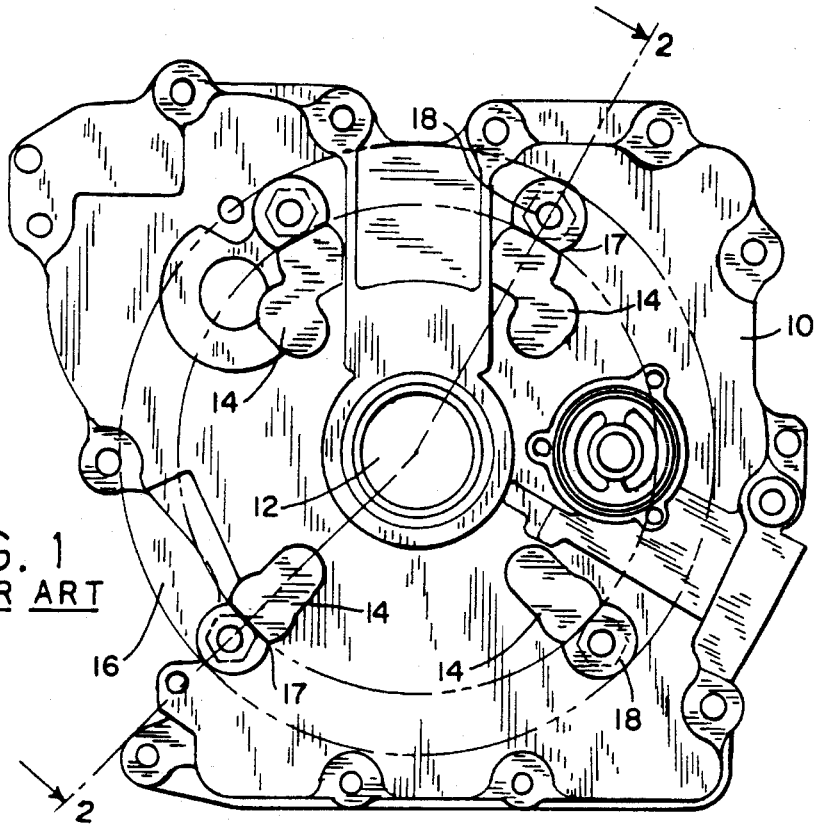
FIG. 1
PRIOR ART
FIG 2
PRIOR ART
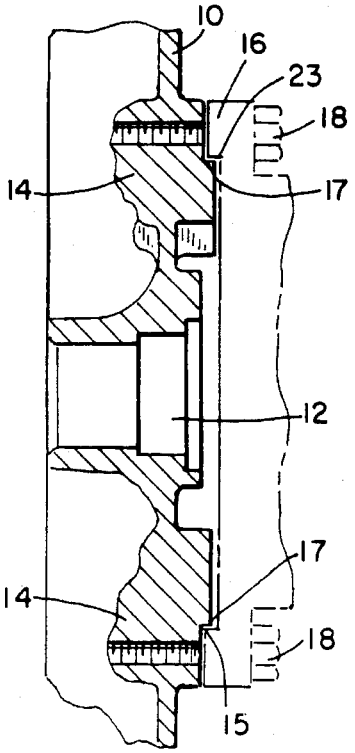
FIG. 5
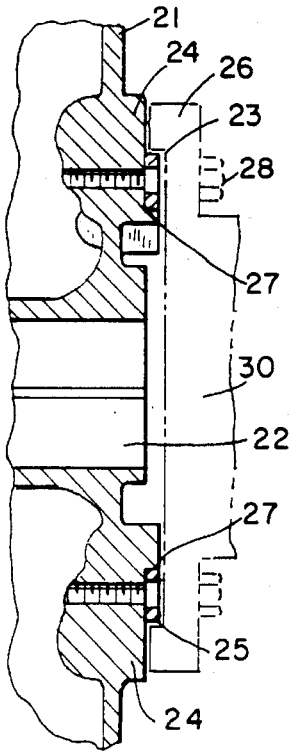
FIG. 6
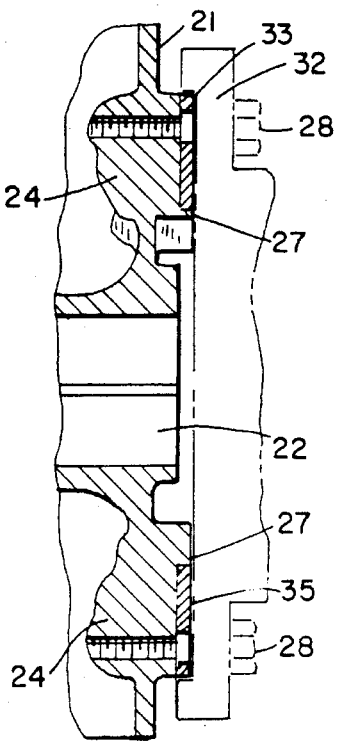

PILOT RING ATTACHMENT ASSEMBLY

BACKGROUND OF THE INVENTION

The field of the invention is power sources, and more particularly, attachment devices for guiding and connecting a power driven apparatus to a power source such as a power take-off (PTO).

In order to connect power sources such as engines to a power driven apparatus such as a generator, it is commonplace to have a machined step, such as a locator, machined on the PTO flange or face of the crankcase. This poses a problem in that each power driven apparatus or application presents a variation requiring a separate machining configuration of the crankcase to accommodate a locator ring on the power driven apparatus.

It is known in the prior art to provide PTO adapters which provide improved centering and piloting capabilities. This is shown in U.S. Pat. Nos. 5,099,704 and 5,170,674. Further, it is also known in the art to provide a ring adapter for modifying the stator of an automotive torque convertor. This is described in U.S. Pat. No. 4,841,615.

The prior art does not provide a simplified device or method whereby only a single machining operation need be done on the PTO flange or face of an engine so as to accommodate the locator rings of various power driven apparatus which are of various diameters. This is effected through the present invention.

SUMMARY OF THE INVENTION

The objects of the invention therefore include:

a. providing a pilot ring assembly and method of use for locating and connecting various power driven apparatus to an engine or motor;
b. providing a pilot ring assembly of the foregoing type which obviates additional machining steps; and
c. providing a pilot ring assembly of the foregoing type which is simple in its construction and thus effects high cost savings in its use.

The objectives are fulfilled by a pilot ring assembly for locating various power driven apparatus to the housing of a power source. The power source housing has an opening for a PTO shaft. There are flanges connected to the block and surrounding the opening. A locator step is positioned in the flanges with the locator step in each of the flanges aligned in a circular manner around the opening. A pilot ring is connected to the flanges and abuts against the locator step at its inner diameter and abutting against a locator ring of the power driven apparatus at its outer diameter.

In one aspect, the flanges are adapted to receive pilot rings of different outside diameters.

In another aspect, there are four flanges positioned essentially at one, four-thirty, seven-thirty, and eleven o'clock around the opening.

In a preferred embodiment, the power source housing is an engine block.

In another preferred embodiment, the pilot ring and the locator ring of the power driven apparatus to be driven by the PTO shaft are bolted to the power source housing by the same bolt.

In another aspect, a method of mounting and aligning various power driven apparatus to a power source housing is presented wherein only a single machining step to mounting flanges is required to accommodate pilot rings having different outside diameters.

BRIEF DESCRIPTION OF THE DRAWINGS

FIG. 1 is a view in side elevation showing a prior art engine crankcase with a locator ring attached thereto;

FIG. 2 is a view in section taken along line 2—2 of FIG. 1;

FIG. 5 is a view similar to FIG. 2 showing a locator ring attached to the pilot ring assembly of this invention; and FIG. 6 is a view similar to FIG. 5 showing a different size pilot ring assembly accommodating a different size locator ring.

DESCRIPTION OF THE PREFERRED EMBODIMENT

Figure 3:
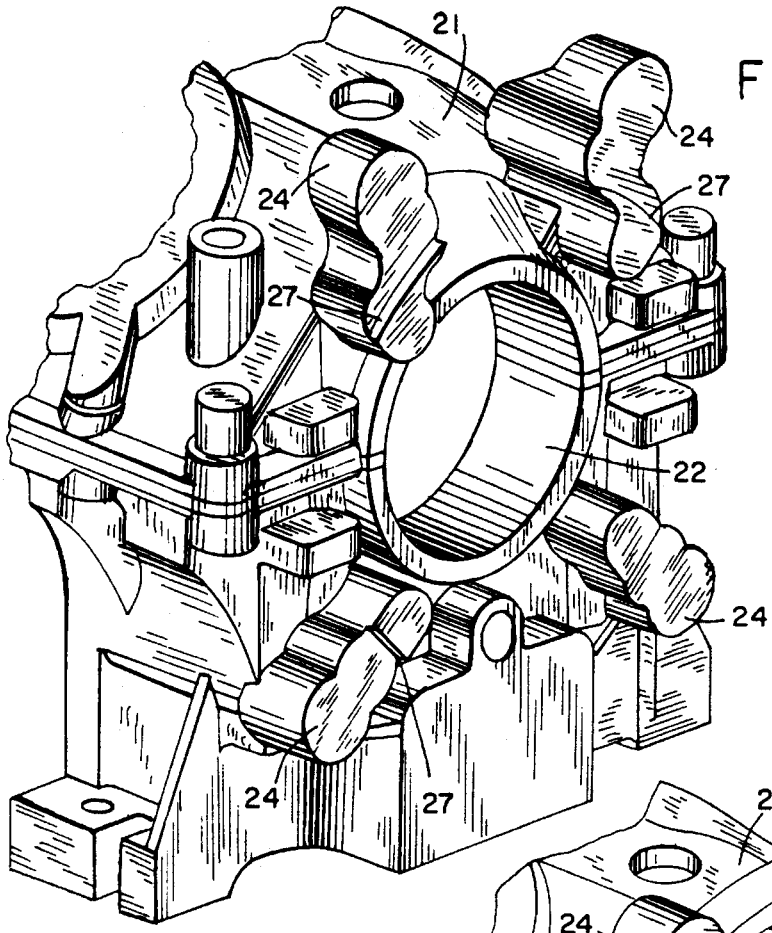
FIG. 3 is a perspective view showing an engine crankcase to which a pilot ring of this invention is to be attached.

A crankcase 10 is shown in FIG. 1 having the usual PTO opening 12 for a drive shaft (not shown). It represents the prior art with a locator ring 16 connected to the crankcase 10 by means of the bolts 18 threaded into the crankcase flanges 14. As seen in FIG. 2, the annular inward shoulder portion 15 of the locator ring 16 is seated against the usual step locator surfaces 17 in the flanges 14.

Figure 4:
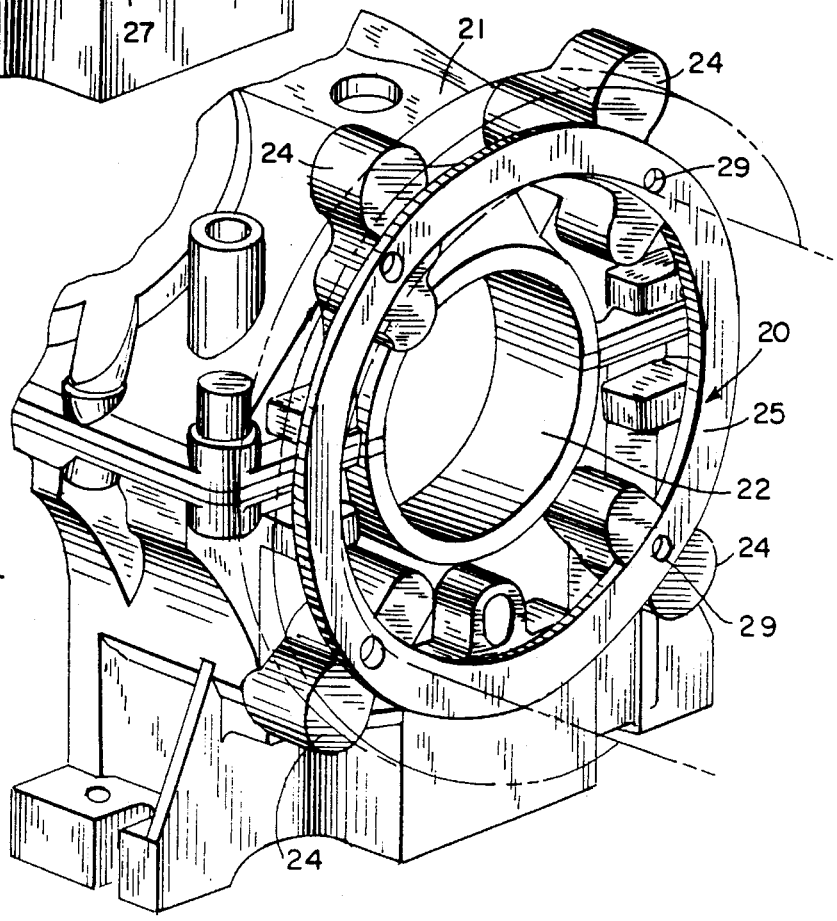
FIG. 4 is a view similar to FIG. 3 showing the pilot ring assembly of this invention attached thereto.

Referring to FIG. 4, the pilot ring assembly generally 20 of this invention is shown with a crankcase 21 which is also shown in FIG. 3 and is of the type described in U.S. Pat. No. 5,341,781 which is commonly assigned. The teachings of this patent are hereby included by reference. It should be pointed out that this particular crankcase is for illustrative purposes only and that any type of typical crankcase can be used in conjunction with the pilot ring assembly of this invention such as the type shown in FIG. 1. Crankcase 21 has the same type of flanges 24 as shown for crankcase 10. They are cast thereon and surround the usual crankcase opening 22 for a PTO shaft. The step locator surfaces 27 are machined thereon in a circular manner around the opening 22.

Referring to both FIGS. 4 and 5, there is shown one of the pilot rings 25 of the assembly 10 positioned on the flanges 24 and abutted with its inner diameter against the step locator surfaces 27 and its outer diameter abutting against the locator ring 26 of a power driven apparatus 30 such as a generator. The locator ring 26 as well as the pilot ring 25 are aligned with the PTO opening 22 and attached to the crankcase 21 such as by the bolts 28 threadably engaging the flanges 24.

The advantages of the pilot ring assembly 10 can best be appreciated in comparing FIGS. 2, 5 and 6. In FIGS. 2 and 5, locator rings 16 and 26 are shown. It should be pointed out that these locator rings have the same internal diameter portion as shown by the reference numeral 23. However, the step locator surface 27 in FIG. 5 is of a different diameter than that shown at 17 in FIG. 2. This difference is accommodated in FIG. 5 by the pilot ring 25. In order to accommodate locator ring 32 having a different and larger inside diameter as shown by the numeral 33 in FIG. 6, prior art practices would require the machining of different step locator surfaces on the flanges 24. However, it should be noted that step locator surfaces 27 in both FIGS. 5 and 6 are exactly the same with respect to their diameter. The larger diameter 33 of the locator ring 32 is accommodated by a larger diameter pilot ring 35. Accordingly, step locator surfaces 27 can accommodate varying sizes of locator rings without having to machine different diameter locations for the step locator surfaces to accommodate locator rings 26 and 32.

While the pilot rings of this invention have been previously mentioned specifically in conjunction for their use with a generator, it should be appreciated that other power driven apparatus can be accommodated such as welders, pumps, concrete saws, leaf blowers, power washers and chippers and shredders.

Although the present invention has been described in the context of an internal combustion engine, it is equally applicable to motors having housings and shafts. Further, while there have been shown four flanges for use in conjunction with the pilot ring, any number of flanges could be utilized with the locator step depending upon specific applications.

I claim:

1. A pilot ring assembly for locating various power driven apparatus to a power source comprising:

a power source housing having an opening for a power take off shaft;

flanges connected to the housing and surrounding the opening;

a locator step positioned in the flanges, the locator step in each flanges aligned in a circular manner around the opening; and a pilot ring connected to the flanges and abutting against the locator step at its inner diameter and abutting against a locator ring of a power driven apparatus at its outer diameter.

2. The pilot ring assembly of claim 1, wherein the flanges are adapted to receive pilot rings of different outside diameters.

3. The pilot ring assembly of claim 1, wherein there are four flanges positioned essentially at one, four-thirty, seven-thirty, and eleven o'clock around the opening.

4. The pilot ring assembly as defined in claim 1, wherein power source housing is an engine block.

5. The pilot ring assembly as defined in claim 1, wherein the pilot ring and the locator ring of the power driven apparatus are bolted to the power source housing by the same bolt.

6. A method of mounting and aligning a power driven apparatus to power source housing comprising:

providing flanges on a power source housing having an opening for a power take-off shaft;

providing a locator step on the flanges which are aligned in a circular manner around the opening; and placing a pilot ring on the flanges with the inside diameter of the pilot ring abutting against the locator step and the outside diameter adapted to abut against a locator ring of a power driven apparatus.

7. The method of claim 6, wherein the power source housing is an engine block.

8. The method of claim 7, wherein the flanges are cast on the engine block.

9. The method of claim 6, wherein the locator step is machined into the flanges.

10. The method of claim 6, wherein the pilot ring and the locator ring of the power driven apparatus are bolted to the power source housing by the same bolt.

* * * * *